US011725482B2

(12) United States Patent
Nguyen

(10) Patent No.: US 11,725,482 B2
(45) Date of Patent: Aug. 15, 2023

(54) ELECTRICALLY ACTUATED TUBULAR CLEANING SYSTEM

(71) Applicant: Tuan Nguyen, Pearland, TX (US)

(72) Inventor: Tuan Nguyen, Pearland, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 96 days.

(21) Appl. No.: 17/508,311

(22) Filed: Oct. 22, 2021

(65) Prior Publication Data

US 2023/0125952 A1 Apr. 27, 2023

(51) Int. Cl.
*E21B 37/02* (2006.01)
*E21B 47/12* (2012.01)

(52) U.S. Cl.
CPC ..... *E21B 37/02* (2013.01); *E21B 47/12* (2013.01)

(58) Field of Classification Search
CPC ..... E21B 37/02; E21B 10/325; E21B 10/32; E21B 23/08; E21B 47/12; E21B 37/00; E21B 37/04; E21B 37/045
See application file for complete search history.

(56) References Cited

U.S. PATENT DOCUMENTS 2,207,920 A 7/1940 Hughes
5,109,924 A 5/1992 Jurgens et al.
5,893,413 A * 4/1999 Lembcke ..... E21B 23/06 166/321
6,318,466 B1 11/2001 Ohmer et al.
7,357,182 B2 4/2008 Hunt et al.
11,421,496 B1 8/2022 Nguyen et al.
2003/0183388 A1 10/2003 Toulouse et al.
2003/0205374 A1 11/2003 Toulouse et al.
2011/0203063 A1* 8/2011 Atkins ..... B08B 9/0436 29/525
2015/0021029 A1 1/2015 Abrant et al.
2015/0090459 A1* 4/2015 Cain ..... B08B 9/051 166/335
2016/0145973 A1* 5/2016 Lykkebo ..... E21B 10/325 166/162
2016/0230508 A1* 8/2016 Jensen ..... E21B 4/04
2016/0305232 A1 10/2016 Bird et al.
(Continued)

FOREIGN PATENT DOCUMENTS

CN 107237612 A * 10/2017
EP 1592865 B1 8/2007
(Continued)

OTHER PUBLICATIONS

International Search Report and Written Opinion dated Feb. 14, 2023 in PCT/US2022/046869; 11 pages.
(Continued)

*Primary Examiner* — Daniel P Stephenson
(74) *Attorney, Agent, or Firm* — Cantor Colburn LLP

(57) ABSTRACT

A tubular cleaning system includes a housing having an outer surface, an inner surface, and a recess. A deployable tool is arranged in the recess. A motor is arranged in a cavity formed the housing between the outer surface and the inner surface. An actuator is operatively connected between the motor and the deployable tool. The motor is selectively activated through a signal to extend the deployable tool.

16 Claims, 13 Drawing Sheets

(56) References Cited

U.S. PATENT DOCUMENTS

| | | | | |
|---|---|---|---|---|
| 2017/0067318 | A1* | 3/2017 | Haugland | E21B 37/02 |
| 2017/0350203 | A1 | 12/2017 | Rud | |
| 2018/0135372 | A1 | 5/2018 | Degeare et al. | |
| 2019/0003264 | A1 | 1/2019 | Swadi et al. | |
| 2019/0106940 | A1 | 4/2019 | Korf et al. | |
| 2019/0162046 | A1* | 5/2019 | Engevik | E21B 31/20 |
| 2020/0190908 | A1 | 6/2020 | Pray et al. | |
| 2021/0301615 | A1 | 9/2021 | Harrington et al. | |
| 2021/0372219 | A1 | 12/2021 | Brown-Kerr et al. | |
| 2021/0381339 | A1 | 12/2021 | Taylor et al. | |
| 2022/0162920 | A1 | 5/2022 | Pray et al. | |
| 2022/0268101 | A1 | 8/2022 | Pray | |
| 2023/0125952 | A1* | 4/2023 | Nguyen | E21B 47/12<br>166/311 |

FOREIGN PATENT DOCUMENTS

| | | | | |
|---|---|---|---|---|
| EP | 1999338 | B1 | 7/2010 | |
| EP | 2366056 | B1 | 6/2014 | |
| WO | WO-2009108068 | A1 * | 9/2009 | A46B 13/02 |
| WO | 2013159237 | A1 | 10/2013 | |
| WO | 2019083922 | A1 | 5/2019 | |

OTHER PUBLICATIONS

International Search Report and Written Opinion dated Feb. 16, 2023 in PCT/US2022/046871; 10 pages.
International Search Report and Written Opinion dated Feb. 17, 2023 in PCT/US2022/046868; 11 pages.

* cited by examiner

ELECTRICALLY ACTUATED TUBULAR CLEANING SYSTEM

BACKGROUND

In the resource recovery industry various tools are deployed into a tubular string during downhole operations. For example, a work string may be employed into the tubular string to clean internal surfaces prior to setting a tool such as an anchor, a packer, or the like. The work string may include scrapers or brushes that are deployed at a specific location. Once deployed the work string may be rotated and moved up and down to clean internal surfaces of the tubular string.

Various technologies may be employed to deploy the brush and/or scraper in a wellbore. For example, a shifting tool may be deployed to urge a sleeve downward to force the scraper outward. In other cases, pressure may be applied to a piston. The pressure may be applied directly to the piston or by dropping a ball or dart and raising pressure in the work string. In either instance, considerable time is required to deploy and subsequently retract the scraper. Running a tool into the work string may take hours or days. Similarly, applying pressure, especially in connection with a ball or dart, can take precious time. Accordingly, operators would welcome a system for more rapidly deploying and retracting a brush and/or scraper in a wellbore.

SUMMARY

Disclosed, in accordance with a non-limiting example, is a tubular cleaning system including a housing having an outer surface, an inner surface, and a recess. A deployable tool is arranged in the recess. A motor is arranged in a cavity formed the housing between the outer surface and the inner surface. An actuator is operatively connected between the motor and the deployable tool. The motor is selectively activated through a signal to extend the deployable tool.

Also disclosed, in accordance with a non-limiting example, is a resource exploration and recovery system including a surface system, a subsurface system operatively connected to the surface system, and a tubular string supporting a tubular cleaning system extending from the surface system into the subsurface system. The tubular cleaning system includes a housing having an outer surface, an inner surface, and a recess. A deployable tool is arranged in the recess. A motor is arranged in a cavity formed the housing between the outer surface and the inner surface. An actuator is operatively connected between the motor and the deployable tool. The motor is selectively activated through a signal to extend the deployable tool.

Further disclosed, in accordance with a non-limiting example, is a method of deploying a tool in a wellbore including sending a signal along a tubular string extending into a wellbore of the subsurface system, receiving the signal at a receiver located in a housing of a tubular cleaning system connected to the tubular string, activating a motor with the signal, and shifting an actuator with the motor to deploy the tool.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
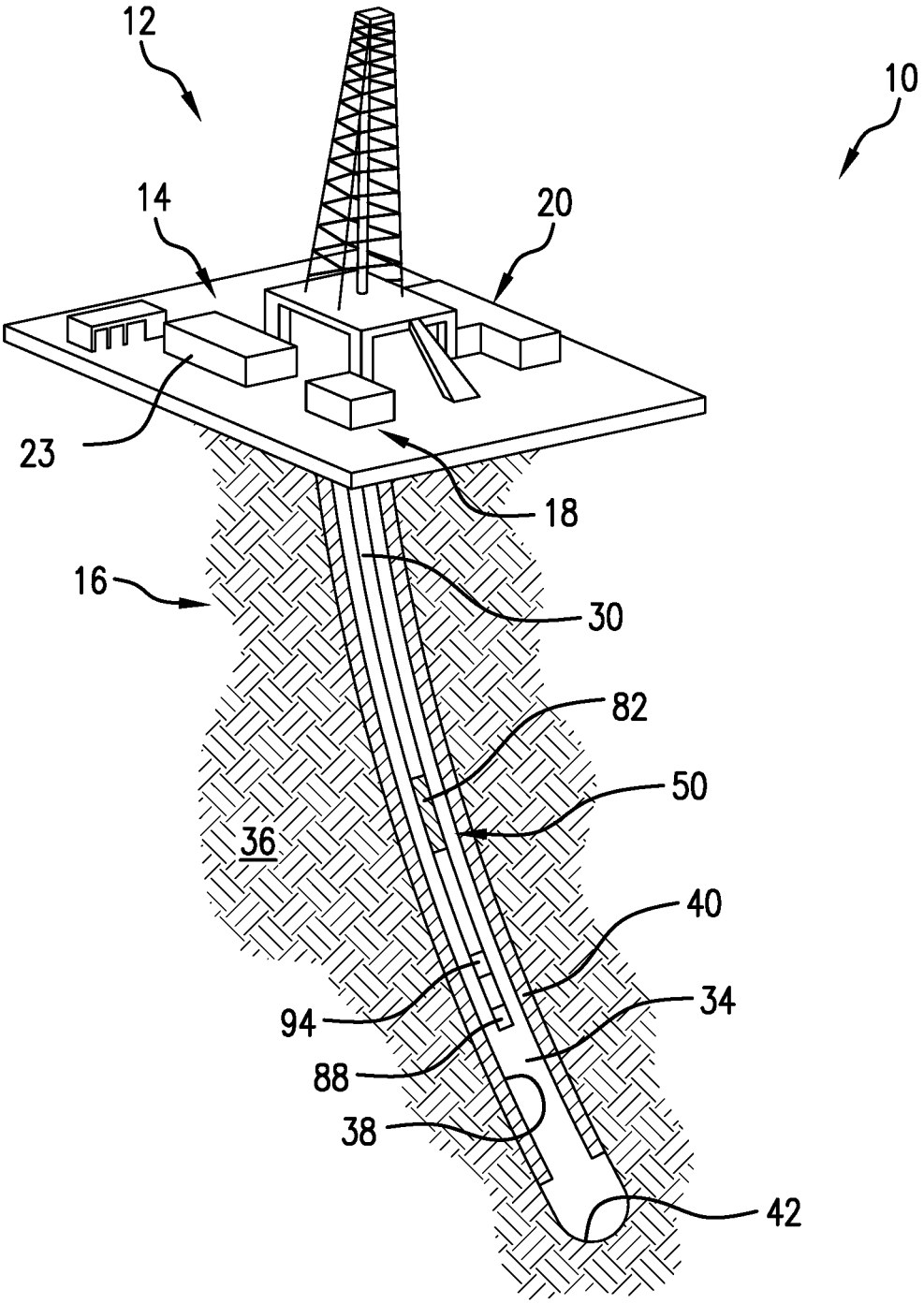
FIG. 1 depicts a resource exploration and recovery system including an electrically activated tubular cleaning system, in accordance with a non-limiting example.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from a plurality of tubulars (not separately labeled) that is extended into a wellbore 34 formed in formation 36. Wellbore 34 includes an annular wall 38 that may be defined by a casing tubular 40 that extends from first system 12 towards a toe 42 of wellbore 34.

Figure 2:
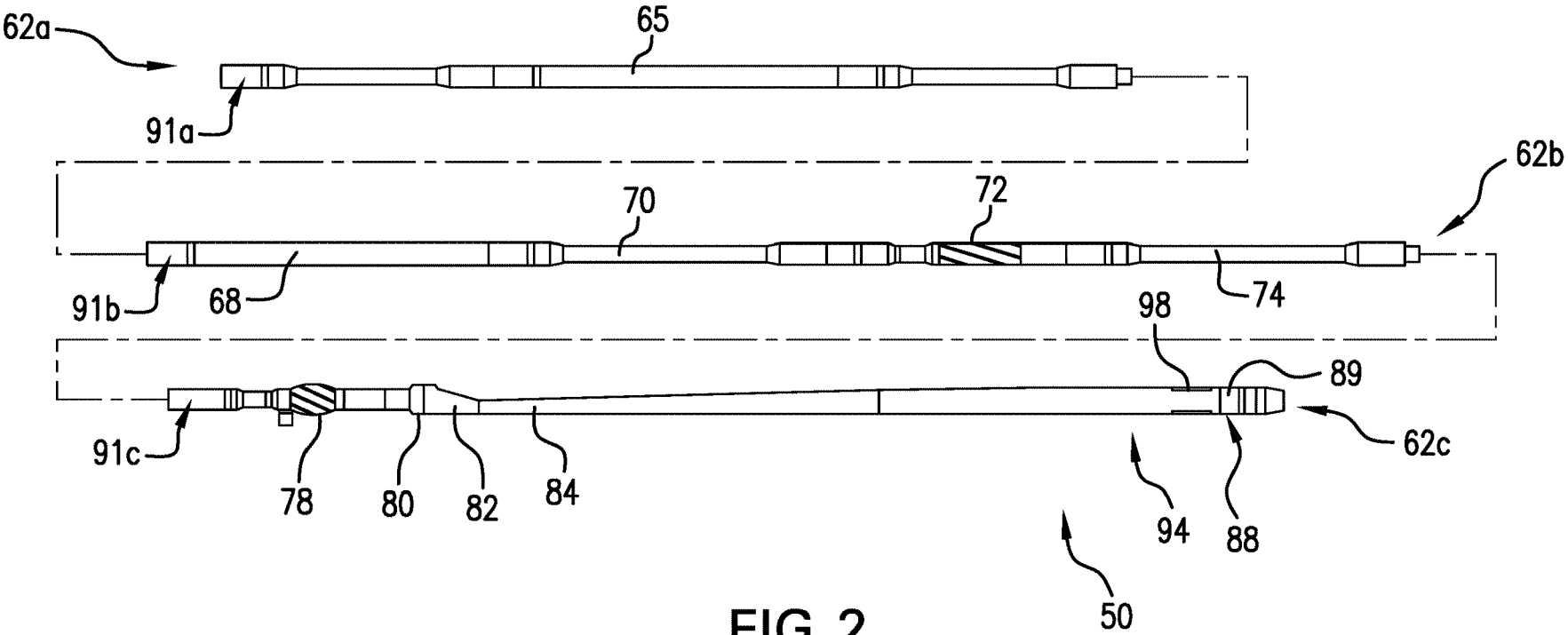
FIG. 2 depicts a work string including the electrically activated tubular cleaning system of FIG. 1, in accordance with a non-limiting example.

In accordance with an exemplary aspect, tubular string 30 may support a window cutting system 50 as shown in FIG. 2. Window cutting system 50 is lowered to a selected depth, affixed to casing tubular 40, and activated to form a window. The window represents an opening in casing tubular 40 that allows a branch to be formed from wellbore 34. In the embodiment shown, window cutting system 50 is formed from a number of tubular segments 62*a*, 62*b*, and 62*c* as shown in FIG. 2. Each segment 62*a*, 62*b*, and 62*c* may be made up off-site and delivered to first system 12 for introduction into wellbore 34. At this point, while shown as including a casing exit (e.g., window cutting) system, tubular string 30 may support any of a wide variety of wellbore operation tools/systems.

In an embodiment, first segment 62*a* may support a measurement while drilling (MWD) system 65 that includes various instrumentation systems which monitor window cutting operations. Second segment 62*b* may include a whipstock valve 68, a first flex joint 70, an upper watermelon mill 72, and a second flex joint 74. Third segment 62*c* may include a lower watermelon mill 78, a window mill 80, a whipstock connector 82, a whipstock 84, and an anchor 88 that may include one or more slips 89. Whipstock connector 82 serves as an interface between window mill 80 and whipstock 84. In a non-limiting example, a plurality of wireless repeaters 91*a*. 91*b*, and 91*c* are arranged on corresponding ones of tubular segments 62*a*, 62*b*, and 62*c*. As will be detailed herein, wireless repeaters 91*a*, 91*b*, and 91*c* are coupled to control system 23 and are operable to promulgate a wireless signal along tubular string 30.

In a non-limiting example, a tubular cleaning system 94 is arranged uphole of anchor 88. Tubular cleaning system 94 includes a selectively deployable tool 98 that may be used to clean annular wall 38 prior to setting anchor 88 and/or before initiating a window cutting operation. Tubular cleaning system 94 may, in accordance with a non-limiting example, include a series of selectively deployable tools each having a different cleaning characteristic. That is, a first tool may be deployed to clean annular wall 38 to a first finish, a second tool may then be deployed to clean annular wall to a second finish. Subsequently, a third tool may be deployed to clean annular wall 38 to a third or final finish ready to receive, for example, anchor 88.

In a non-limiting example, tubular cleaning system 94 includes a housing 107 having an annular wall 110 including an outer surface 112 and an inner surface 114 that may define a conduit 116. Housing 107 includes a recess 120 that may support deployable tool 98. Recess 120 may be annular or may take the form of a plurality of discrete recesses. Recess 120 includes an inner surface section 122. Spaced from recess 120 is a control compartment 124. Like recess 120, control compartment 124 may be annular or may take the form of multiple discrete compartments. Control compartment 124 includes a selectively removable cover 128. A plurality of passages, one of which is indicated at 132 is arranged between recess 120 and control compartment 124.

In a non-limiting example, deployable tool 98 takes the form of a scraper blade 136 having a first surface 138 and an opposing second surface 140. First surface 138 includes a plurality of scraper blade elements (not separately labeled). A plurality of power springs 142 is arranged between second surface 140 and inner surface section 122 or recess 120. Scraper blade 136 also includes an actuator receiver 147 disposed between first surface 138 and second surface 140. Actuator receiver 147 includes an angled surface 150. Actuator receiver 147 and power springs 142 aid in the deployment of scraper blade 136 as will be detailed herein.

Figure 3:
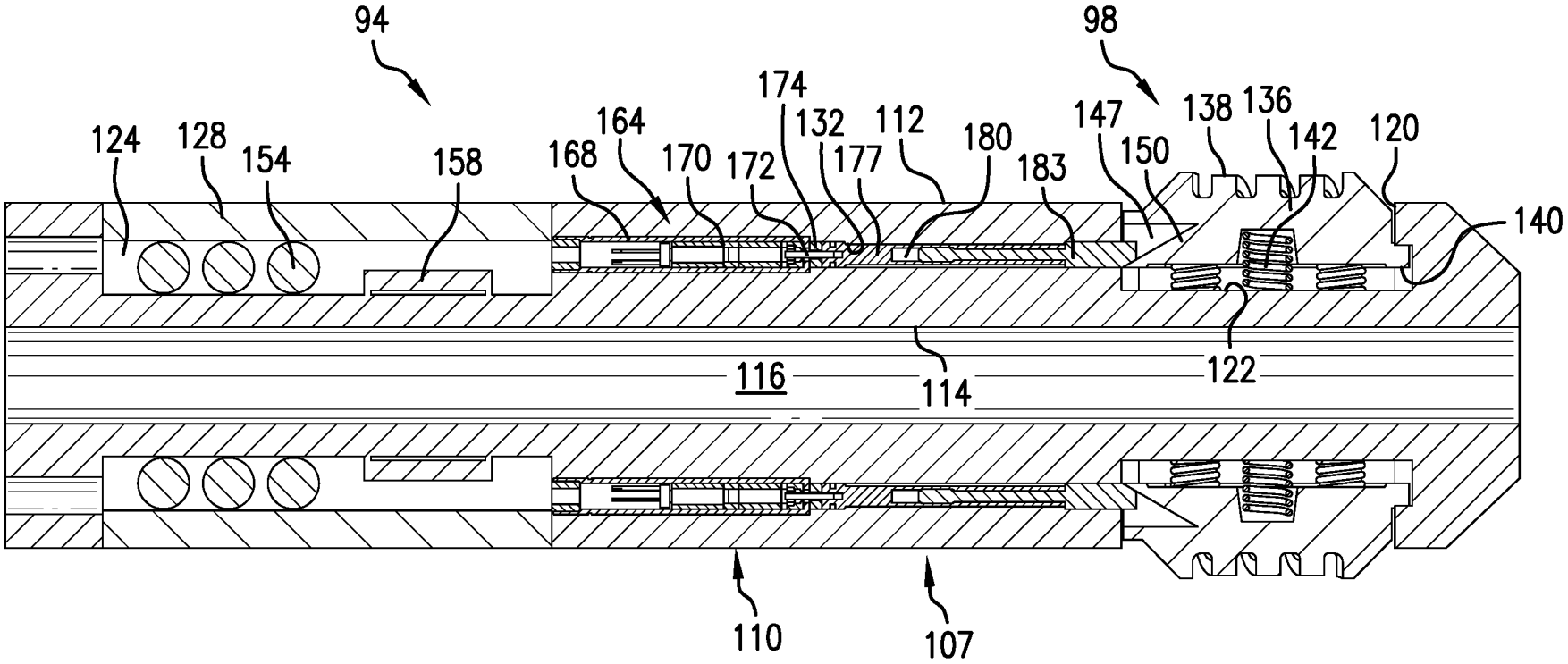
FIG. 3 depicts the electrically activated tubular cleaning system in a deployed configuration, in accordance with a non-limiting example.
Figure 4:
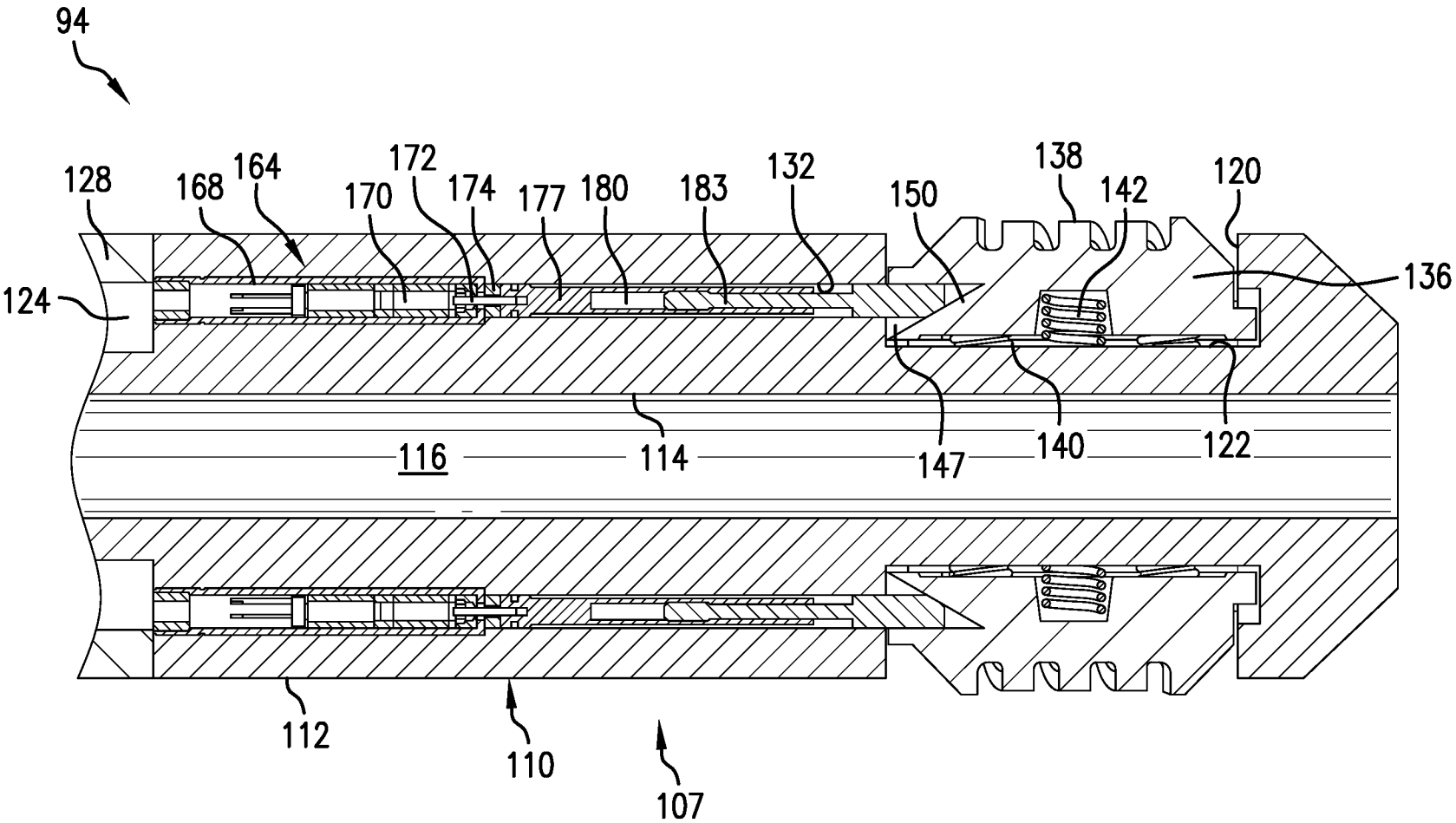
FIG. 4 depicts a portion of the electrically activated tubular cleaning system of FIG. 3 in a run-in-hole configuration, in accordance with a non-limiting example.

In a non-limiting embodiment, control compartment 124 houses a battery 154 as well as electronics package 158 that may include a repeater and/or a wireless receiver (not separately labeled). Battery 154 powers a motor system 164 disposed in passage 132. Electronics package 158 provide an interface between battery 154, wireless repeaters 91*a*, 91*b*, and 91*c* and motor system 164 to selectively shift scraper blade 136 between a run in hole configuration (FIG. 4) and a deployed configuration (FIG. 3) ready to clean annular wall 38.

In a non-limiting example, motor system 164 includes a sleeve 168 disposed in passage 132. A wireless motor 170, having an output shaft 172, is disposed within sleeve 168. It should be understood that the term "wireless motor" describes a motor that receives command and control signals through a wireless interface. Wireless motor 170 may communicate with electronics package 158 through either a wired connection or a wireless connection. Output shaft 172 is supported by a thrust bearing 174. A drive shaft 177 is connected to output shaft 172. Drive shaft 177 is axially fixed yet rotatable within passage 132. Drive shaft 177 includes an internally threaded passage 180. An actuator 183 extends into internally threaded passage 180 and is connected to drive shaft 177. Actuator 183 is externally threaded and connects with drive shaft 177 through a threaded connection. At this point, it should be understood that while described as a wireless motors, motors connected by a wireline (not shown) be also be employed.

Figure 5:
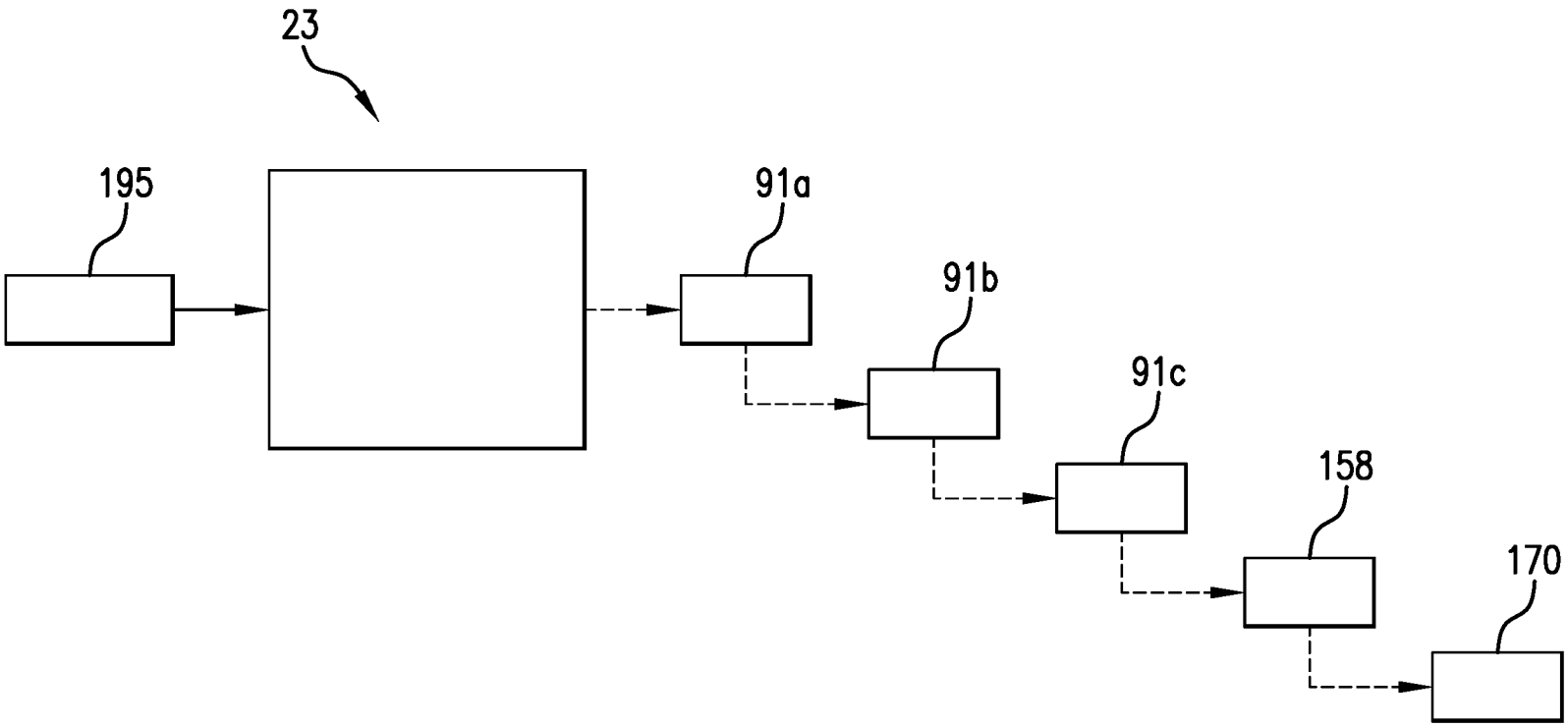
FIG. 5 depicts a block diagram illustrating a control system for the electrically activated tubular cleaning system, in accordance with a non-limiting example.
Figure 6:
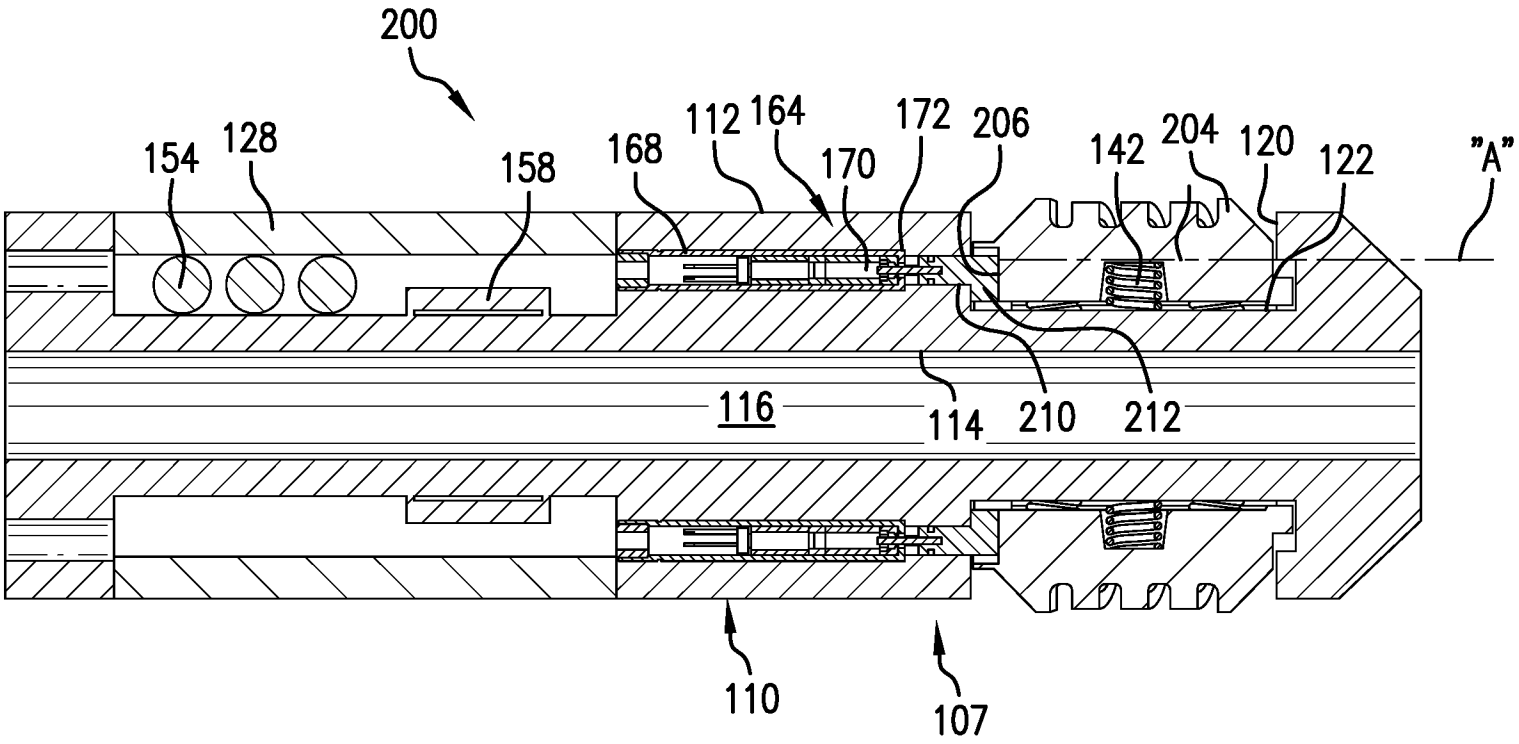
FIG. 6 depicts a cross-sectional side view of an electrically activated tubular cleaning system in accordance with another non-limiting example in a run in configuration.
Figure 7:
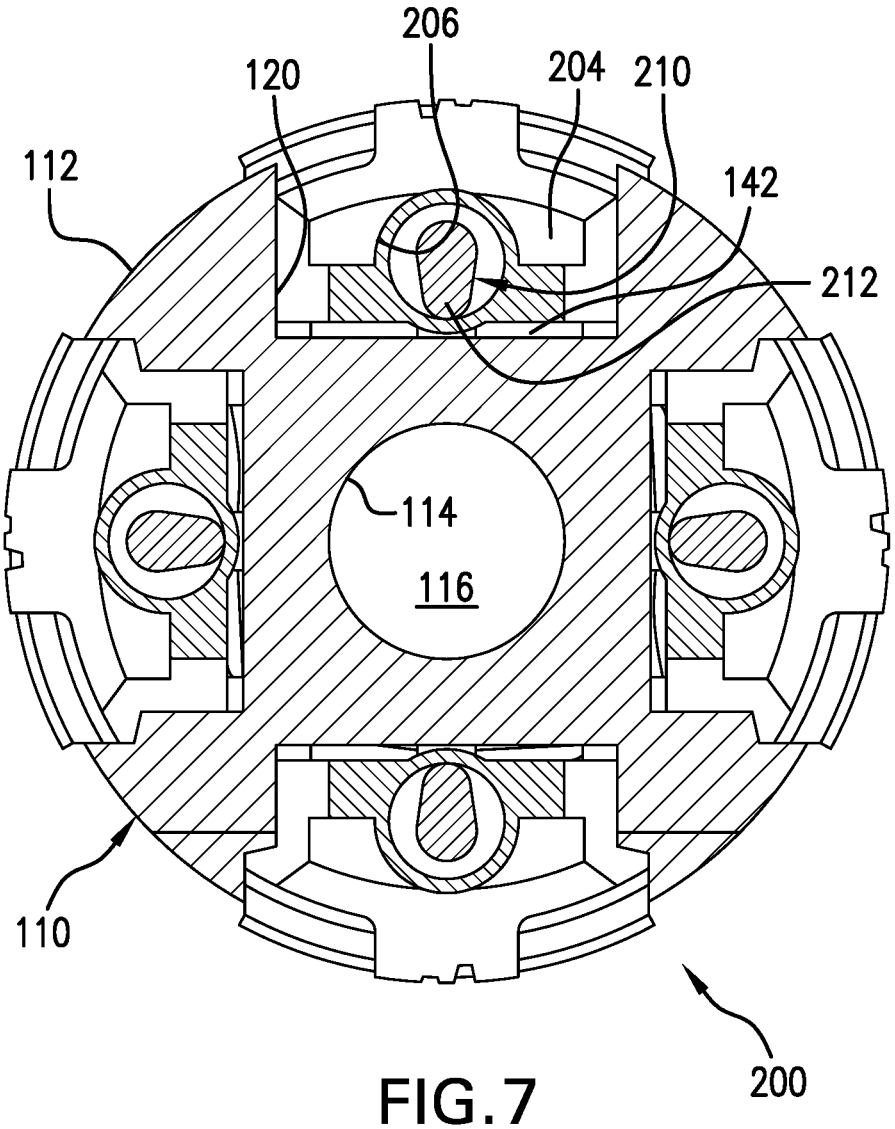
FIG. 7 is an axial end view of the electrically activated tubular cleaning system of FIG. 6, in accordance with a non-limiting example.
Figure 8:
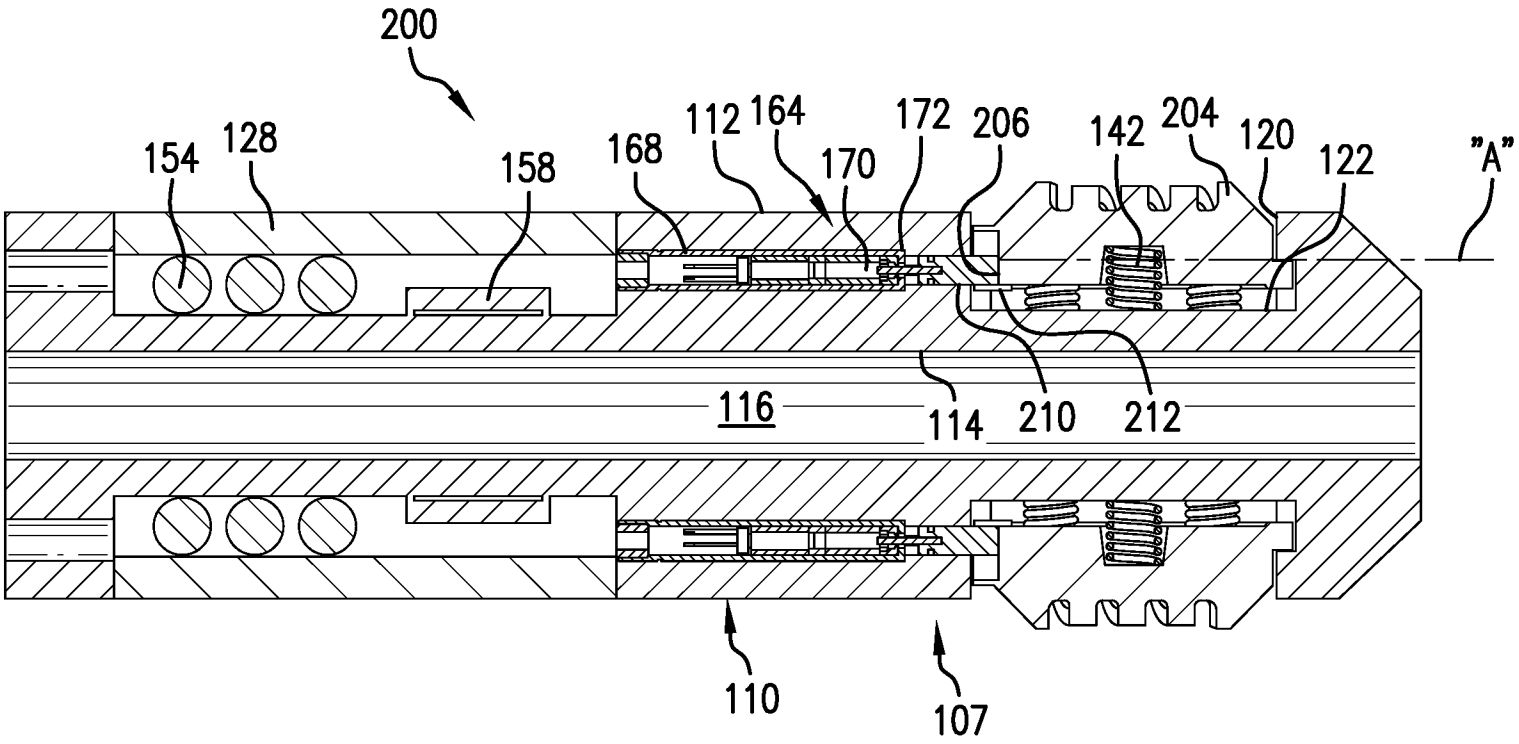
FIG. 8 depicts a cross-sectional side view of the electrically activated tubular cleaning system of FIG. 6 in a deployed configuration.
Figure 9:
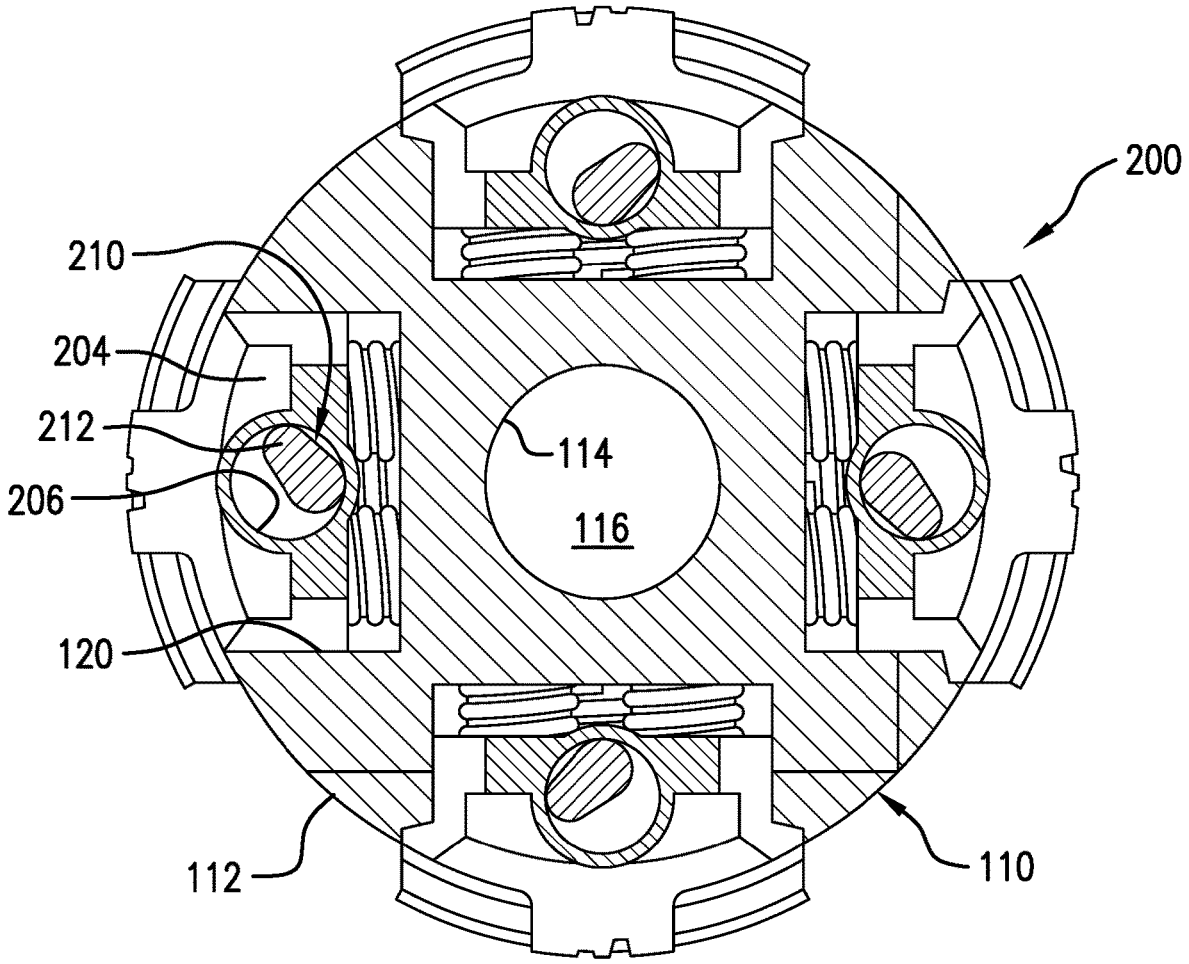
FIG. 9 is an axial end view of the electrically activated tubular cleaning system of FIG. 8, in accordance with a non-limiting example.
Figure 10:
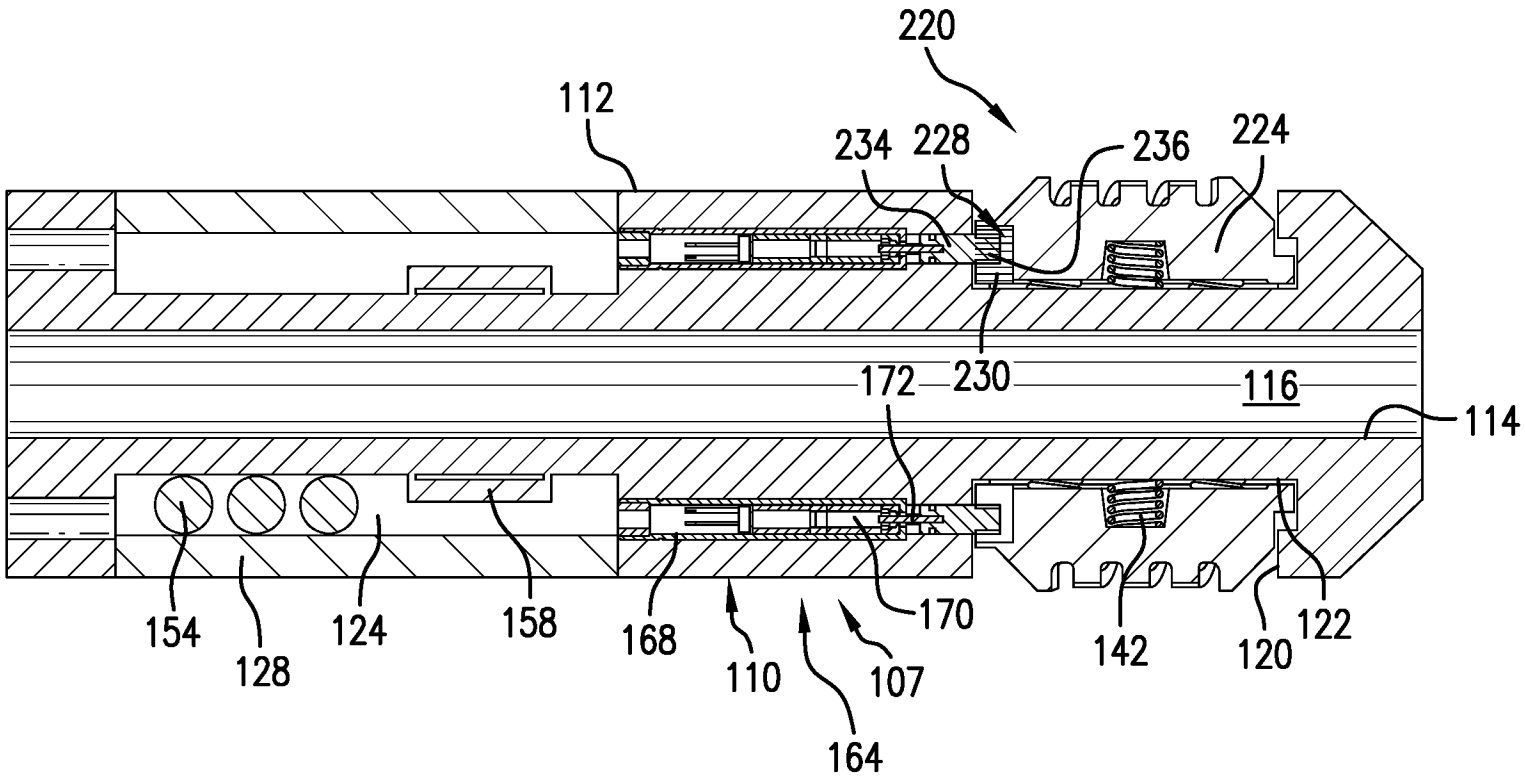
FIG. 10 depicts a cross-sectional side view of an electrically activated tubular cleaning system in accordance with yet another non-limiting example in a run in configuration.
Figure 11:
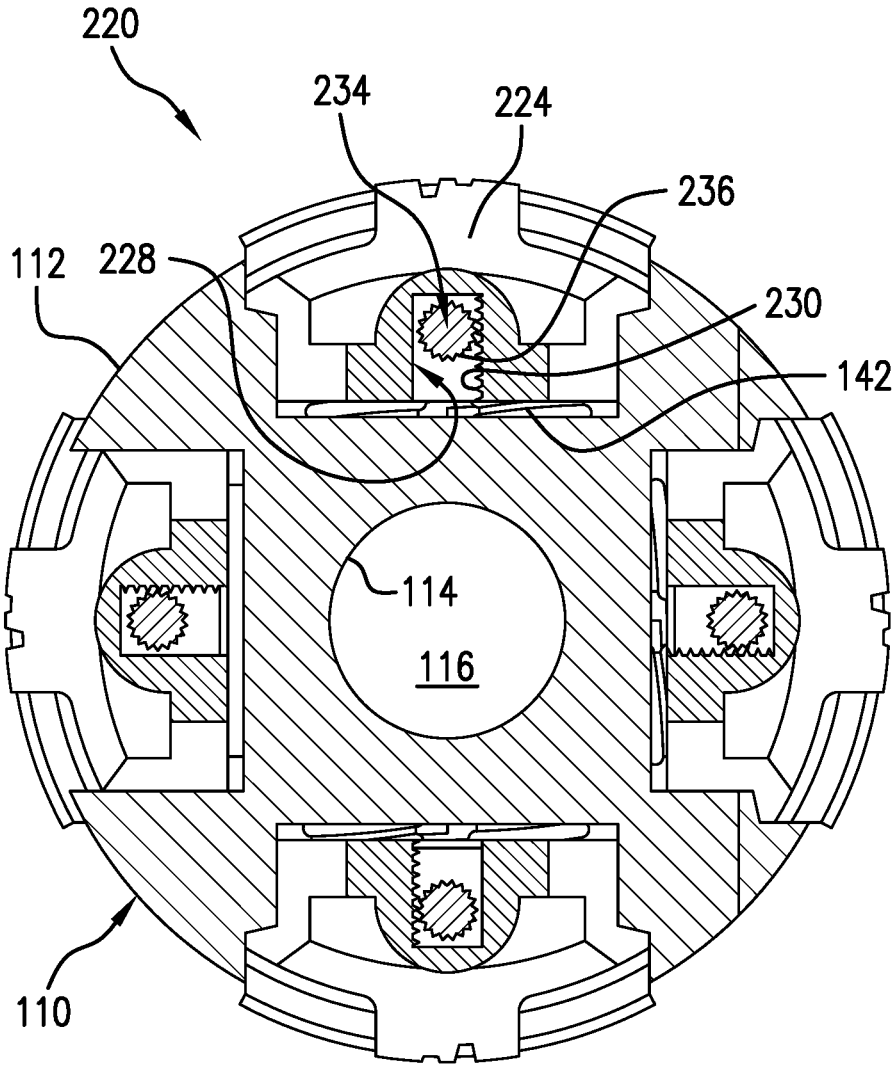
FIG. 11 is an axial end view of the electrically activated tubular cleaning system of FIG. 10, in accordance with a non-limiting example.
Figure 12:
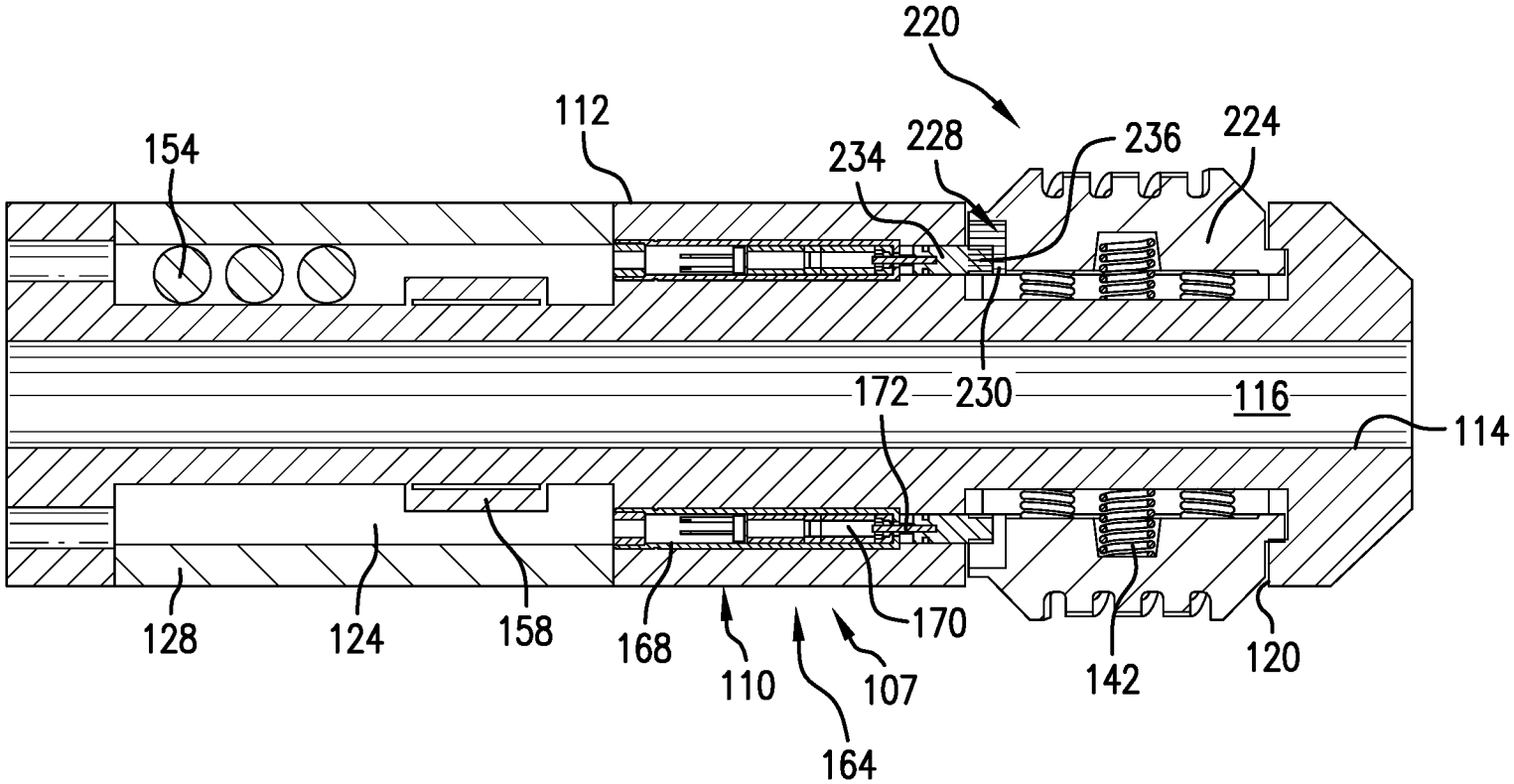
FIG. 12 depicts a cross-sectional side view of an electrically activated tubular cleaning system of FIG. 10 in a deployed configuration.
Figure 13:
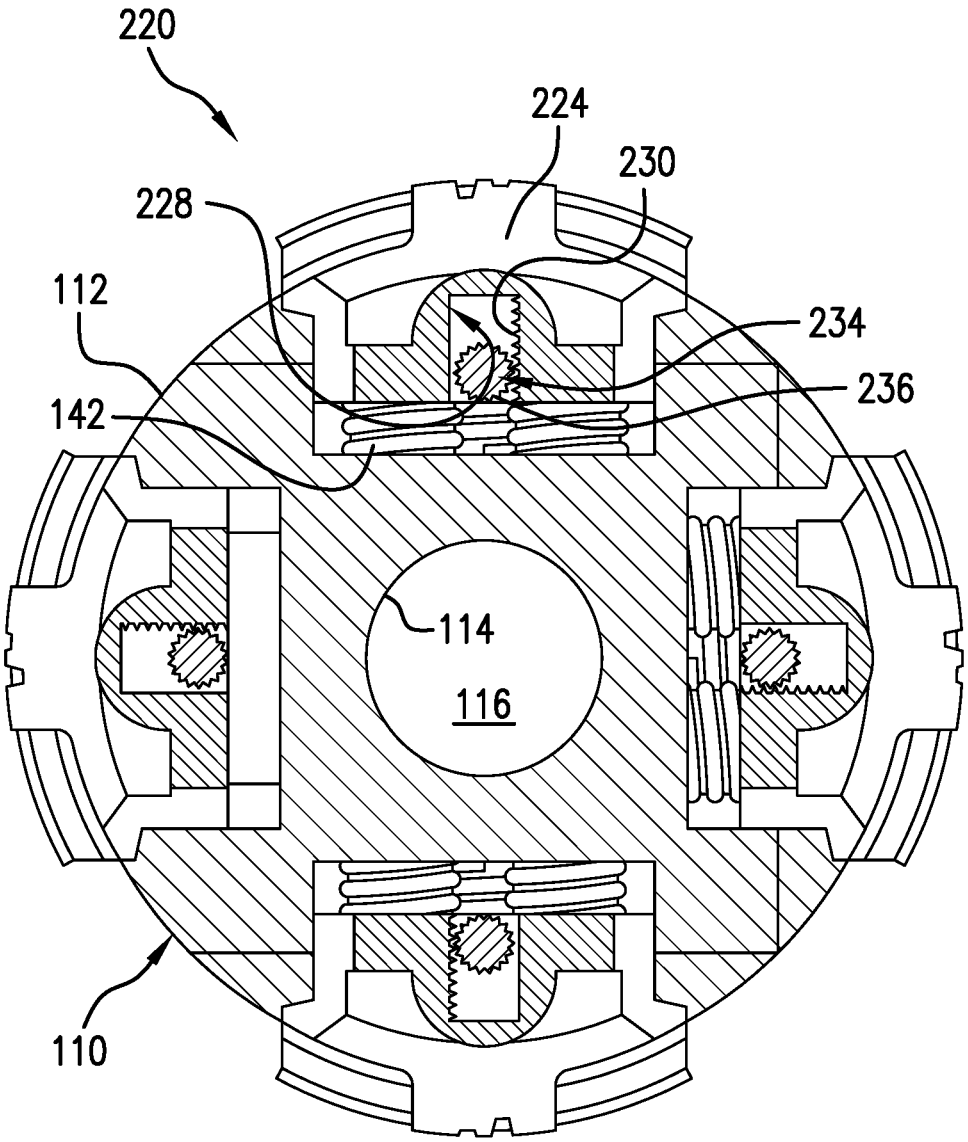
FIG. 13 is an axial end view of the electrically activated tubular cleaning system of FIG. 12, in accordance with a non-limiting example.

With this arrangement, an activator 195 shown in FIG. 5 may be engages to deliver a wireless signal along repeaters 91*a*, 91*b*, and 91*c* into electronics package 158. A command signal, which may take a variety of forms including wired and wireless communication protocols, is passed from electronics package to activate wireless motor 170. When rotated in a first direction, output shaft 172 drives actuator 183 to move toward scraper blade 136, into actuator receiver 147 along angled surface 150. As actuator 183 transitions into actuator receiver 147, scraper blade 136 moves radially outwardly.

In contrast, activation of wireless motor 170 causing output shaft 172 to rotate in a second direction, causes actuator 183 to move away from scraper blade 136 along angled surface 150. As actuator 183 transitions away from actuator receiver 147, scraper blade 136 moves radially inwardly. The use of wireless signals significantly reduces the time needed to deploy and retract the scraper blade.

Reference will now follow to FIGS. 6-9, wherein like reference numbers represent corresponding parts in the respective views, in describing a tubular cleaning system 200 in accordance with another non-limiting example. In the non-limiting example shown, tubular cleaning system 200 includes a deployable tool 204 having an annular pocket 206 on an axial end (not separately labeled) thereof. Annular pocket 206 includes a center (also not separately labeled) that is offset from a central longitudinal axis "A" of deployable tool 204.

In a non-limiting example, an actuator 210 is connected directly to output shaft 172. As such, instead of creating a liner force, actuator 210 rotates with output shaft 172 when wireless motor 170 is activated. In a non-limiting example, actuator 210 includes a cam 212 that selectively acts against an inner surface (not separately labeled) of annular pocket 206 directs deployable tool radially outwardly or radially inwardly, depending upon a direction of rotation of wireless motor 170. With this arrangement, deployable tool 204 can be shifted between a run in hole configuration (FIG. 6) and a deployed configuration (FIG. 8) and points in between. As discussed herein, while described as a wireless motors, motors connected by a wireline (not shown) be also be employed.

Reference will now follow to FIGS. 10-13, wherein like reference numbers represent corresponding parts in the respective views, in describing a tubular cleaning system 220 in accordance with another non-limiting example. In the non-limiting example shown, tubular cleaning system 220 includes a deployable tool 224 having a pocket 228 including a surface 230 having a plurality of gear teeth (not separately labeled). In a non-limiting example, an actuator 234 is connected directly to output shaft 172. As such, instead of creating a liner force, actuator 234 rotates with output shaft 172 when wireless motor 170 is activated.

In a non-limiting example, actuator 234 includes gear teeth 236 that selectively engage with the gear teeth on surface 230 on pocket 228 to direct deployable tool radially outwardly or radially inwardly, depending upon a direction of rotation of wireless motor 170. With this arrangement, deployable tool 224 can be shifted between a run in hole configuration (FIG. 10) and a deployed configuration (FIG. 12) and points in between.

Set forth below are some embodiments of the foregoing disclosure:

Embodiment 1. A tubular cleaning system comprising: a housing including an outer surface, an inner surface, and a recess; a deployable tool arranged in the recess; a motor arranged in a cavity formed the housing between the outer surface and the inner surface; and an actuator operatively connected between the motor and the deployable tool, the motor being selectively activated through a signal to extend the deployable tool.

Embodiment 2. The tubular cleaning system according to any prior embodiment, wherein the motor comprises a wireless motor.

Embodiment 3. The tubular cleaning system according to any prior embodiment, further comprising: a wireless receiver operatively connected to the wireless motor.

Embodiment 4. The tubular cleaning system according to any prior embodiment, further comprising: a tubular string including a first end, a second end, and an intermediate portion extending between the first end and the second end, the housing being mounted at the second end; and a plurality of wireless signal repeaters arranged along the intermediate portion of the tubular string.

Embodiment 5. The tubular cleaning system according to any prior embodiment, wherein the selectively deployable tool comprises a scraper including a body having an actuator receiver.

Embodiment 6. The tubular cleaning system according to any prior embodiment, wherein the actuator receiver includes an angled surface, the actuator being selectively shifted along the angled surface to deploy the scraper.

Embodiment 7. The tubular cleaning system according to any prior embodiment, wherein the housing includes a controls compartment for receiving a battery and an electronics package including the wireless receiver, the battery and the electronics package being operatively connected to the wireless motor.

Embodiment 8. The tubular cleaning system according to any prior embodiment, further comprising: a selectively removeable cover arranged over the controls compartment, wherein the battery, electronics, and wireless motor are accessible through the cover.

Embodiment 9. A resource exploration and recovery system comprising: a surface system; a subsurface system operatively connected to the surface system; and a tubular string supporting a tubular cleaning system extending from the surface system into the subsurface system, the tubular cleaning system comprising: a housing including an outer surface, an inner surface, and a recess; a deployable tool arranged in the recess; a motor arranged in a cavity formed the housing between the outer surface and the inner surface; and an actuator operatively connected between the motor and the deployable tool, the motor being selectively activated through a signal to extend the deployable tool.

Embodiment 10. The resource exploration and recovery system according to any prior embodiment, wherein the motor comprises a wireless motor.

Embodiment 11. The resource exploration and recovery system according to any prior embodiment, further comprising: a wireless receiver operatively connected to the wireless motor.

Embodiment 12. The resource exploration and recovery system according to any prior embodiment, wherein the tubular string includes a first end arranged at the surface system, a second end arranged in the subsurface system, and an intermediate portion extending between the first end and the second end, the housing being mounted at the second end; and a plurality of wireless signal repeaters arranged along the intermediate portion of the tubular string.

Embodiment 13. The resource exploration and recovery system according to any prior embodiment, wherein the selectively deployable tool comprises a scraper including a body having an actuator receiver.

Embodiment 14. The resource exploration and recovery system according to any prior embodiment, wherein the actuator receiver includes an angled surface, the actuator being selectively shifted along the angled surface to deploy the scraper.

Embodiment 15. The resource exploration and recovery system according to any prior embodiment, wherein the housing includes a controls compartment for receiving a battery and an electronics package including the wireless receiver, the battery and the electronics package being operatively connected to the wireless motor.

Embodiment 16. The resource exploration and recovery system according to any prior embodiment, further comprising: a selectively removeable cover arranged over the controls compartment, wherein the battery, electronics, and wireless motor are accessible through the cover.

Embodiment 17. A method of deploying a tool in a wellbore comprising: sending a signal along a tubular string extending into a wellbore of the subsurface system; receiving the signal at a receiver located in a housing of a tubular cleaning system connected to the tubular string; activating a motor with the signal; and shifting an actuator with the motor to deploy the tool.

Embodiment 18. The method according to any prior embodiment, wherein sending the signal along the tubular string includes relaying a wireless signal through a plurality of wireless signal repeaters arranged along the tubular string.

Embodiment 19. The method according to any prior embodiment, wherein deploying the tool includes extending a scraper radially outwardly of the housing.

Embodiment 20. The method according to any prior embodiment, further comprising retracting the scraper radially inwardly toward the housing.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A tubular cleaning system comprising:

a housing including an outer surface, an inner surface, and a recess;

a deployable tool arranged in the recess, the deployable tool comprising a scraper including a body having an actuator receiver having an angled surface;

a motor arranged in a cavity formed the housing between the outer surface and the inner surface; and an actuator operatively connected between the motor and the deployable tool, the motor being selectively activated through a signal to engage the angled surface of the actuator receiver and extend the deployable tool.

2. The tubular cleaning system according to claim 1, wherein the motor comprises a wireless motor.

3. The tubular cleaning system according to claim 2, further comprising: a wireless receiver operatively connected to the wireless motor.

4. The tubular cleaning system according to claim 3, further comprising:

a tubular string including a first end, a second end, and an intermediate portion extending between the first end and the second end, the housing being mounted at the second end; and a plurality of wireless signal repeaters arranged along the intermediate portion of the tubular string.

5. The tubular cleaning system according to claim 3, wherein the housing includes a controls compartment for receiving a battery and an electronics package including the wireless receiver, the battery and the electronics package being operatively connected to the wireless motor.

6. The tubular cleaning system according to claim 5, further comprising: a selectively removeable cover arranged over the controls compartment, wherein the battery, electronics, and wireless motor are accessible through the cover.

7. A resource exploration and recovery system comprising:

a surface system;

a subsurface system operatively connected to the surface system; and a tubular string supporting a tubular cleaning system extending from the surface system into the subsurface system, the tubular cleaning system comprising:

a housing including an outer surface, an inner surface, and a recess;

a deployable tool arranged in the recess, the deployable tool comprising a scraper including a body having an actuator receiver having an angled surface;

a motor arranged in a cavity formed the housing between the outer surface and the inner surface; and an actuator operatively connected between the motor and the deployable tool, the motor being selectively activated through a signal to engage the angled surface of the actuator receiver and extend the deployable tool.

8. The resource exploration and recovery system according to claim 7, wherein the motor comprises a wireless motor.

9. The resource exploration and recovery system according to claim 8, further comprising: a wireless receiver operatively connected to the wireless motor.

10. The resource exploration and recovery system according to claim 9, wherein the tubular string includes a first end arranged at the surface system, a second end arranged in the subsurface system, and an intermediate portion extending between the first end and the second end, the housing being mounted at the second end an anchor assembly arranged at the second end; and a plurality of wireless signal repeaters arranged along the intermediate portion of the tubular string, wherein the tubular cleaning system is arranged uphole of the anchor assembly.

11. The resource exploration and recovery system according to claim 9, wherein the housing includes a controls compartment for receiving a battery and an electronics package including the wireless receiver, the battery and the electronics package being operatively connected to the wireless motor.

12. The resource exploration and recovery system according to claim 11, further comprising: a selectively removeable cover arranged over the controls compartment, wherein the battery, electronics, and wireless motor are accessible through the cover.

13. A method of deploying a cleaning tool comprising a scraper including an actuator receiver in a wellbore comprising:

sending a signal along a tubular string extending into a wellbore of the subsurface system;

receiving the signal at a receiver located in a housing of a tubular cleaning system connected to the tubular string;

activating a motor with the signal; and shifting an actuator with the motor into contact with an angled surface of the actuator receiver to deploy the tool.

14. The method of claim 13, wherein sending the signal along the tubular string includes relaying a wireless signal through a plurality of wireless signal repeaters arranged along the tubular string.

15. The method of claim 13, wherein deploying the tool includes extending a scraper radially outwardly of the housing.

16. The method of claim 15, further comprising: retracting the scraper radially inwardly toward the housing.

* * * * *